US006978813B2

(12) United States Patent
Chang

(10) Patent No.: US 6,978,813 B2
(45) **Date of Patent: *Dec. 27, 2005**

(54) SEMI-AUTOMATIC MORTISING MACHINE

(76) Inventor: Chi-Lo Chang, 16-1, Lane 884, San Feng Rd., Feng Yuan, Taichung Hsien (TW)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 11/072,802

(22) Filed: Mar. 4, 2005

(65) Prior Publication Data

US 2005/0145298 A1 Jul. 7, 2005

Related U.S. Application Data

(62) Division of application No. 10/634,185, filed on Jul. 30, 2003, now Pat. No. 6,929,042.

(51) Int. Cl.[7] ..... B27F 5/02; B27C 5/06

(52) U.S. Cl. ..... 144/71; 144/144.1; 144/145.1

(58) Field of Search ..... 144/69–71, 74, 144/82, 85, 87, 368, 371, 372

(56) References Cited

U.S. PATENT DOCUMENTS

| | | | | |
|---|---|---|---|---|
| 1,698,827 A | | 1/1929 | Skolnick | 144/70 |
| 2,586,798 A | | 2/1952 | Eck | 144/87 |
| 2,747,627 A | | 5/1956 | Jaroslav | 144/85 |
| 3,272,244 A | * | 9/1966 | Nemec | 144/87 |
| 3,834,435 A | | 9/1974 | McCord, Jr. | 144/144.51 |
| 2005/0022899 A1 | | 2/2005 | Chang | 144/82 |

* cited by examiner

*Primary Examiner*—Derris H. Banks
*Assistant Examiner*—Shelley Self
(74) *Attorney, Agent, or Firm*—Alan D. Kamrath; Nikolai & Mersereau, P.A.

(57) ABSTRACT

A semi-automatic mortising machine includes a support base, a support bar, a guide device, a working device, a distance adjusting device, and a dust collection box. Thus, the displacement direction can be controlled in a manual manner during the working process, and the cutting operation is performed in an automatic manner so as to cut the mortises and tenons in the workpiece.

3 Claims, 9 Drawing Sheets

SEMI-AUTOMATIC MORTISING MACHINE

CROSS-REFERENCES TO RELATED APPLICATIONS

The present invention is a divisional application of the U.S. Ser. No. 10/634,185, filed on Jul. 30, 2003, now U.S Pat. No. 6,929,042.

BACKGROUND OF THE INVENTION

1. Field of the Invention

The present invention relates to a mortising machine, and more particularly to a mortising machine that is operated in a semi-automatic manual working manner to form mortises and tenons in a workpiece.

2. Description of the Related Art

Referring to FIG. 1, a wood material 1 is formed with a plurality of mortises 11 or a plurality of tenons 12 in a manual manner or by an automatic working process. The manual working manner of the wood material 1 has a very poor working speed, thereby greatly decreasing the working efficiency and thereby increasing costs of production. The automatic working process of the wood material 1 can increases the working speed largely. However, the conventional automatic mortising machine needs a multi-axial displacement feature so as to match the profiles of the mortises and tenons of the workpiece, so that the automatic mortising machine has a very complicate construction, thereby increasing costs of fabrication and maintenance.

SUMMARY OF THE INVENTION

The primary objective of the present invention is to provide a semi-automatic mortising machine, wherein the displacement direction is controlled in a manual manner during the working process, and the cutting operation is performed in an automatic manner so as to cut the mortises and tenons in the workpiece.

Another objective of the present invention is to provide a semi-automatic mortising machine having a largely simplified construction.

A further objective of the present invention is to provide a semi-automatic mortising machine that reduces possibility of malfunction.

A further objective of the present invention is to provide a semi-automatic mortising machine that facilitates an operator's maintenance.

A further objective of the present invention is to provide a semi-automatic mortising machine that maintains the quality of the products.

Further benefits and advantages of the present invention will become apparent after a careful reading of the detailed description with appropriate reference to the accompanying drawings.

DETAILED DESCRIPTION OF THE INVENTION

Figure 1:
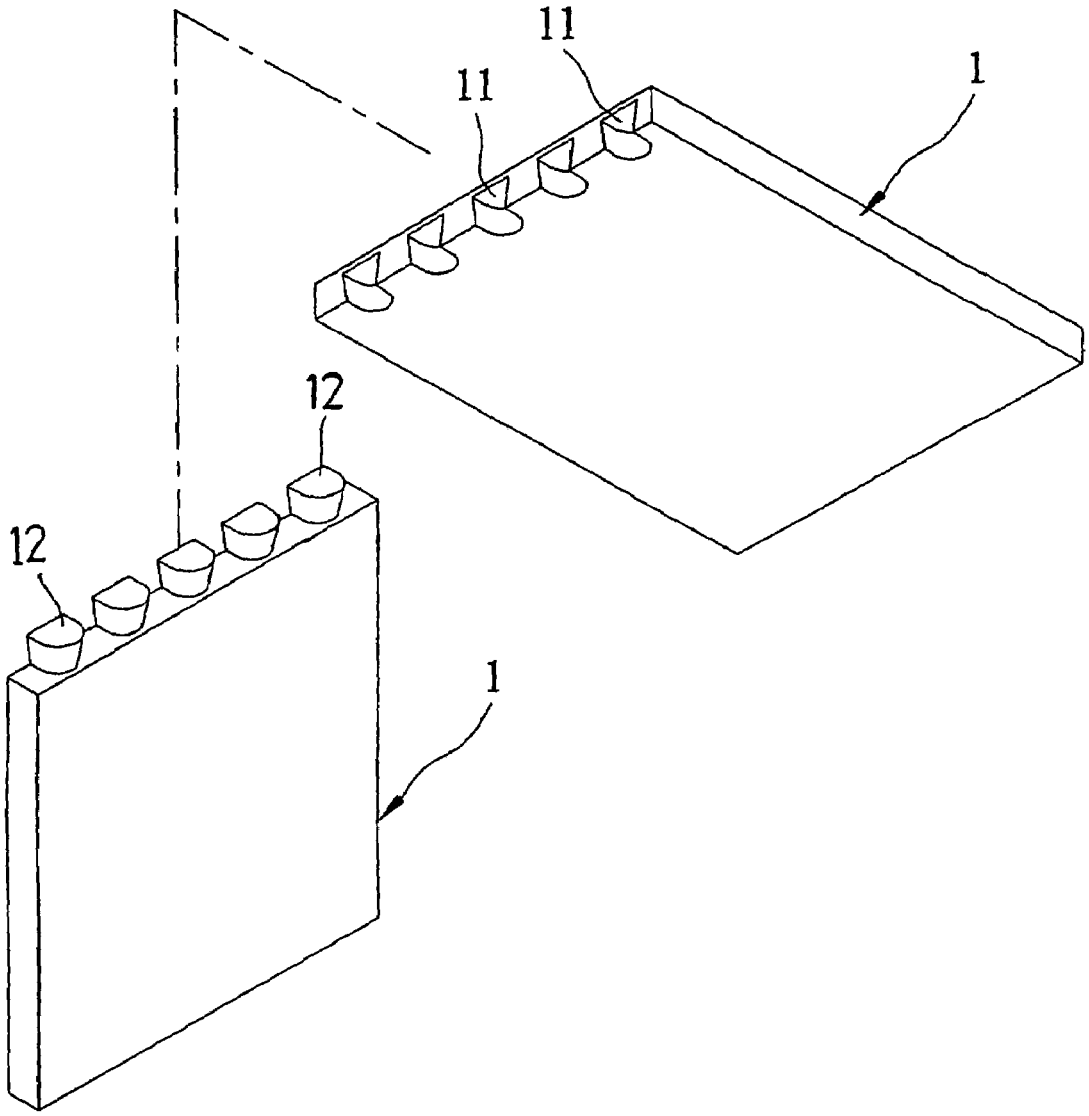
F I G. 1 PRIOR ART
FIG. 1 is a perspective view showing a workpiece being worked by a conventional semi-automatic mortising machine in accordance with the prior art.
Figure 2:
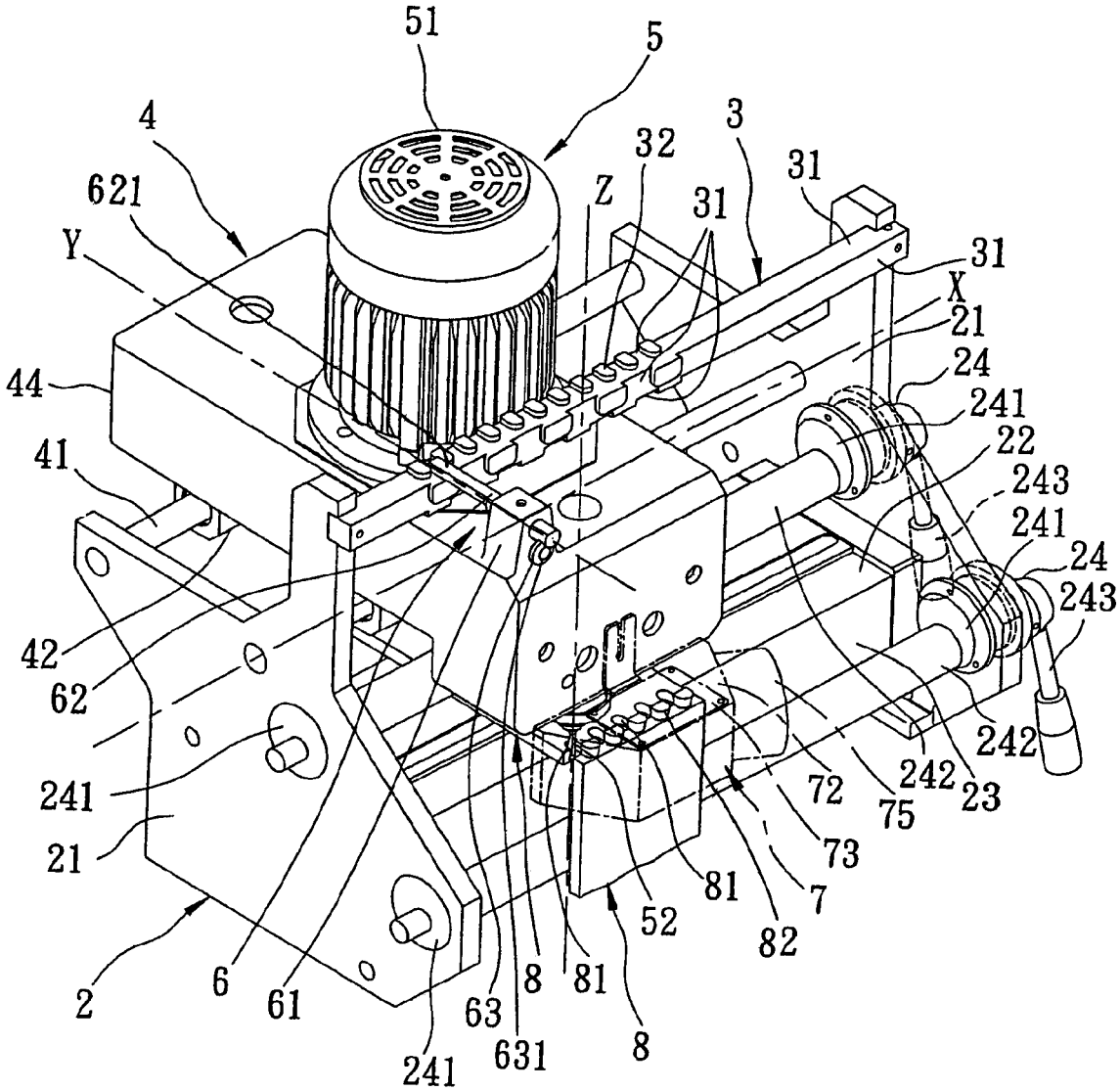
FIG. 2 is a perspective view of a semi-automatic mortising machine in accordance with the preferred embodiment of the present invention.
Figure 3:
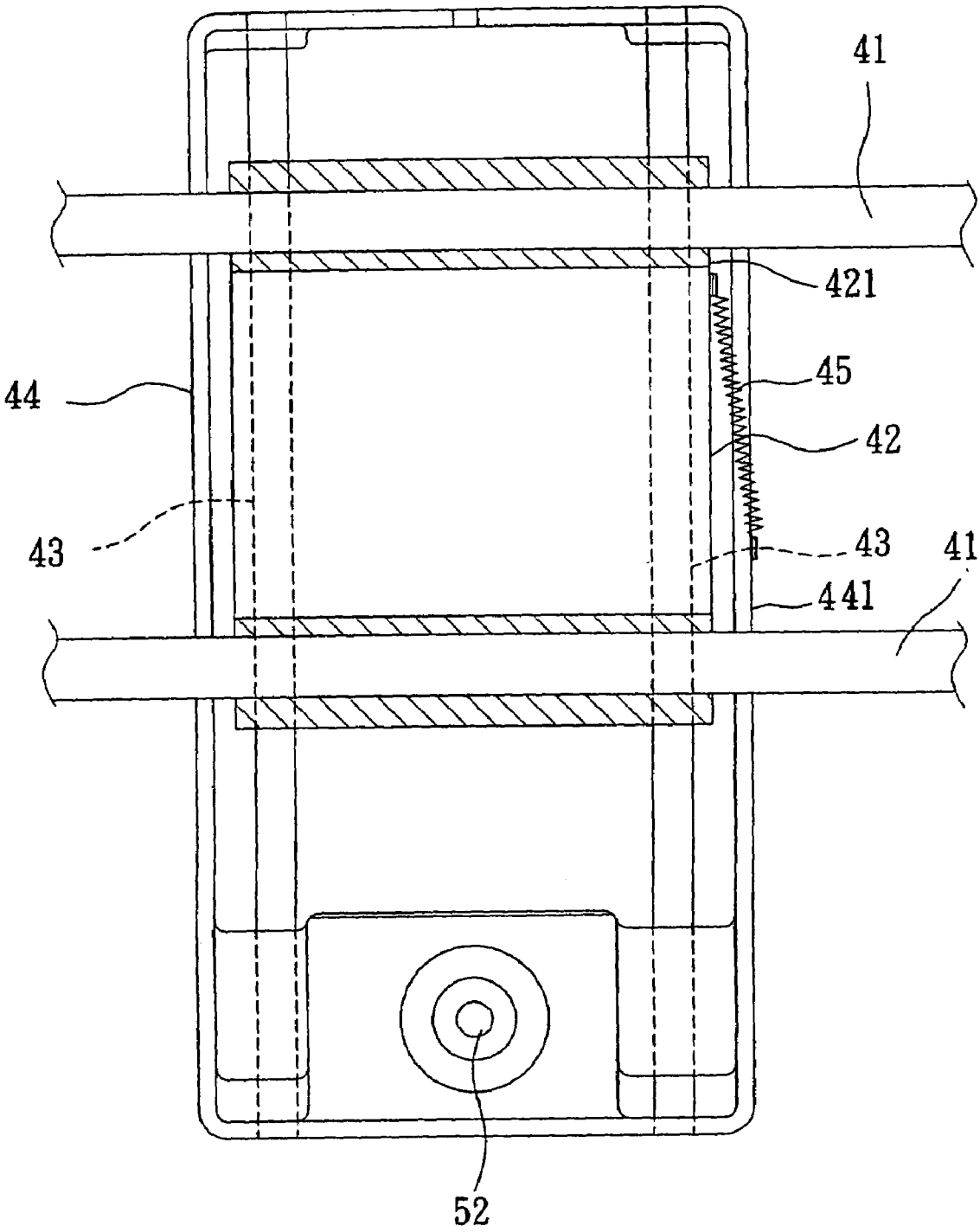
FIG. 3 is a partially cut-away bottom plan cross-sectional view of the semi-automatic mortising machine as shown in FIG. 2.

Referring to the drawings and initially to FIGS. 2–5, a semi-automatic mortising machine in accordance with the preferred embodiment of the present invention comprises a support base 2, a support bar 3, a guide device 4, a working device 5, a distance adjusting device 6, and a dust collection box 7.

The support base 2 includes two side walls 21 arranged in the X-axis direction, two adjacent platforms 22 and 23 each mounted between the two side walls 21 and each extended toward the horizontal face and the vertical face respectively. Thus, two workpieces 8 are placed on the two adjacent platforms 22 and 23 in the horizontal direction and the vertical direction respectively and located adjacent to each other.

The support base 2 further includes two positioning members 24 each including two rotation disks 241 rotatably mounted between the two side walls 21 of the support base 2, a positioning rod 242 eccentrically mounted between the two rotation disks 241, and a drive handle 243 mounted on one of the two rotation disks 241 for rotating the respective rotation disk 241, so that the positioning rod 242 can be moved toward or away from the two platforms 22 and 23 during rotation of the two rotation disks 241 so as to press the two workpieces 8 on the two platforms 22 and 23 or to release the two workpieces 8 from the two platforms 22 and 23.

The support bar 3 is mounted between the two side walls 21 of the support base 2 and located above the platform 22. The support bar 3 has four side faces 31 each formed with a plurality of tenons 32 which are arranged in parallel with the X-axis direction.

The guide device 4 includes two axial displacement rods 41 each mounted between the two side walls 21 of the support base 2, a slide seat 42 slidably mounted on the two axial displacement rods 41 to move in parallel with the X-axis direction, two radial displacement rods 43 each extended through the slide seat 42 to move in parallel with the Y-axis direction, a slide box 44 fixed on the two radial displacement rods 43 to move therewith, and an elastic member 45 mounted between a side 421 of the slide seat 42 and a side 441 of the slide box 44, so that the slide box 44 is constantly moved toward the support bar 3. Preferably, the elastic member 45 is a spring.

The working device 5 includes a motor 51 mounted on the slide box 44, and a blade 52 extended downward in the Z-axis direction. The blade 52 is connected to a reduction mechanism (not shown) which is mounted in the slide box 44 and connected to the motor 51, so that the blade 52 is driven by the motor 51.

The distance adjusting device 6 includes a support rack 61 mounted on a top face of the slide box 44 and directed toward the support bar 3, a molding bar 62 extended through the support rack 61 and in parallel with the Y-axis direction, and a threaded rod 63 screwed onto the support rack 61 and in parallel with the Y-axis direction. The molding bar 62 has a first end formed with a molding end 621 rested on the support bar 3 and a second end formed with a locking end 623 formed with a locking groove 622. The threaded rod 63 has a bolt head 631 locked in the locking groove 622 of the molding bar 62. Thus, the threaded rod 63 is moved relative to the support rack 61 to move the molding bar 62 so as to adjust the distance between the molding end 621 of the molding bar 62 and the support bar 3.

Figure 4:
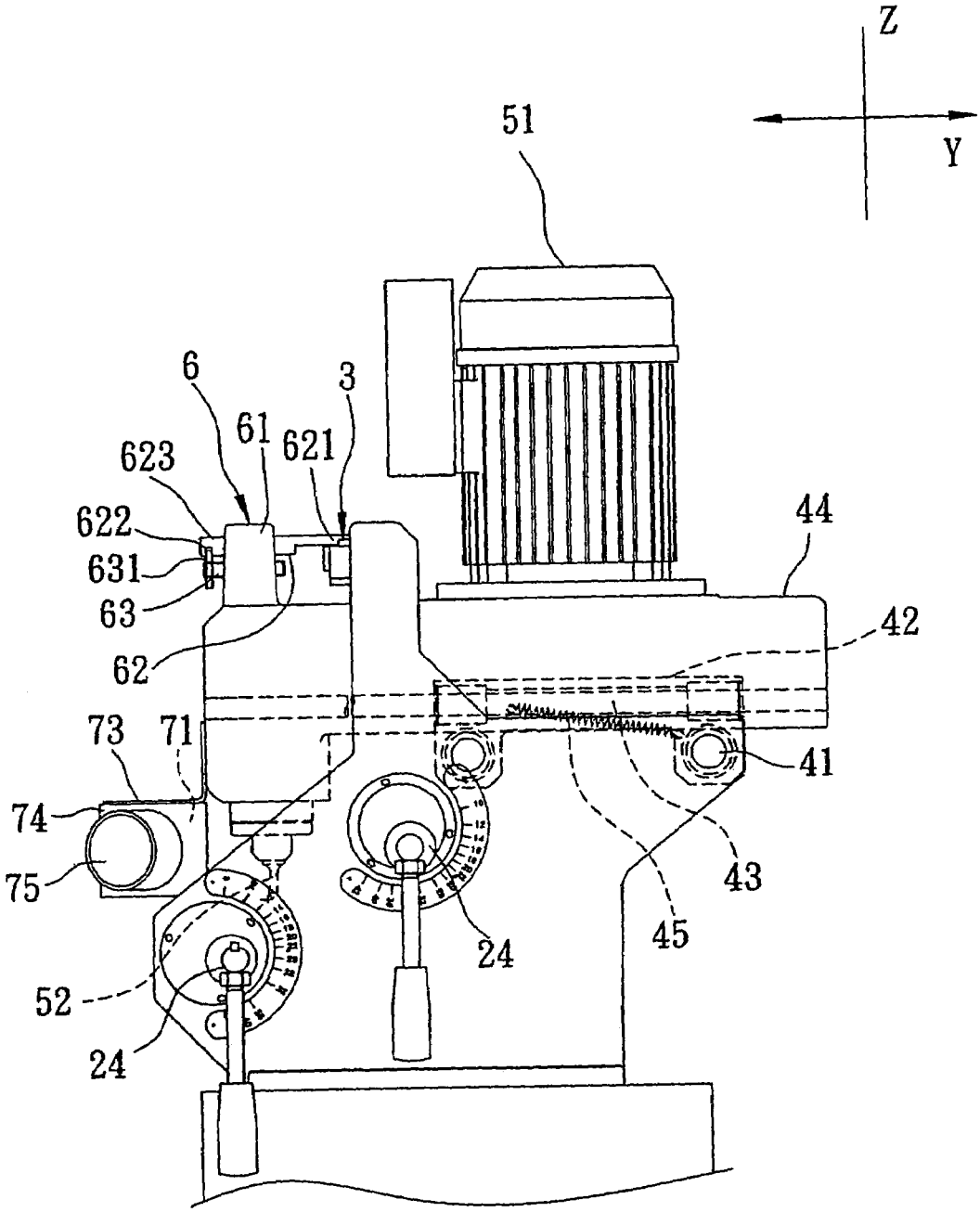
FIG. 4 is a partially cut-away side plan view of the semi-automatic mortising machine as shown in FIG. 2.
Figure 5:
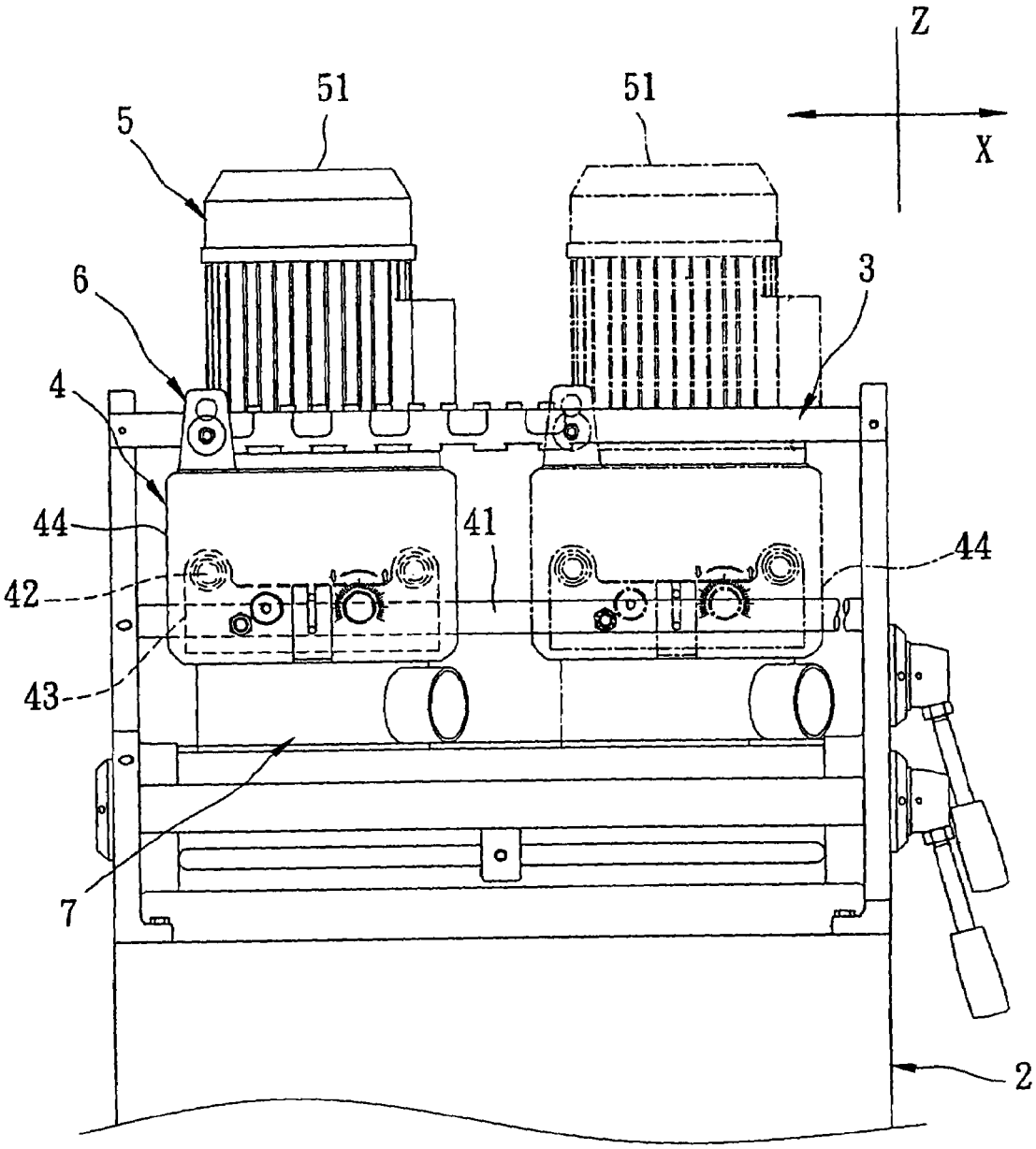
FIG. 5 is a partially cut-away front plan operational view of the semi-automatic mortising machine as shown in FIG. 2.

The dust collection box 7 is secured on the slide box 44 and has an inside formed with opening 71 in parallel with the Y-axis direction and directed toward the blade 52 as shown in FIG. 4, a top face 72 provided with a transparent window 73, and a side 74 formed with a chip drain hole 75 which is connected to a dust cleaning device (not shown), so that the powdered chips produced from the workpiece 8 can enter the dust collection box 7 through the opening 71 and can then be drained outward from the chip drain hole 75. In addition, the operator can inspect the chip drainage condition of the dust collection box 7 through the transparent window 73.

In operation, the motor 51 drives the blade 52 to rotate. At this time, the slide box 44 is pushed or pulled in a manual manner, so that the slide box 44 and the slide seat 42 slide on the axial displacement rods 41 to move in parallel with the X-axis direction, or the slide box 44 and the radial displacement rods 43 slide on the slide seat 42 to move in parallel with the Y-axis direction. Thus, the slide box 44 can be moved in parallel with the X-axis direction and in parallel with the Y-axis direction arbitrarily.

Thus, the molding bar 62 is moved with the slide box 44 to displace in parallel with the X-axis direction and in parallel with the Y-axis direction arbitrarily, so that the molding end 621 of the molding bar 62 is moved along the periphery of each of the tenons 32 of the support bar 3. Thus, the slide box 44 is moved along the moving track of the molding end 621 of the molding bar 62 to drive the blade 52 to move along the moving track of the molding end 621 of the molding bar 62 so as to cut and form mortises 81 and tenons 82 in the workpiece 8 according to the profile and distance of the tenons 32 of the support bar 3, so that the mortises 81 and tenons 82 of the workpiece 8 can match the relative profile and distance of the respective tenons 32 of the support bar 3.

In addition, the slide box 44 is constantly moved toward the support bar 3 by the elastic force of the elastic member 45 to prevent the molding end 621 of the molding bar 62 from detaching from the support bar 3, so that the molding end 621 of the molding bar 62 can align with the corresponding working position of the support bar 3 easily and conveniently.

Further, the four side faces 31 of the support bar 3 are provided with tenons 32 of different forms and distance, so that the molding end 621 of the molding bar 62 is moved along the tenons 32 of different side faces 31 of the support bar 3 so as to cut mortises 81 and tenons 82 of different forms and distance.

Figure 6:
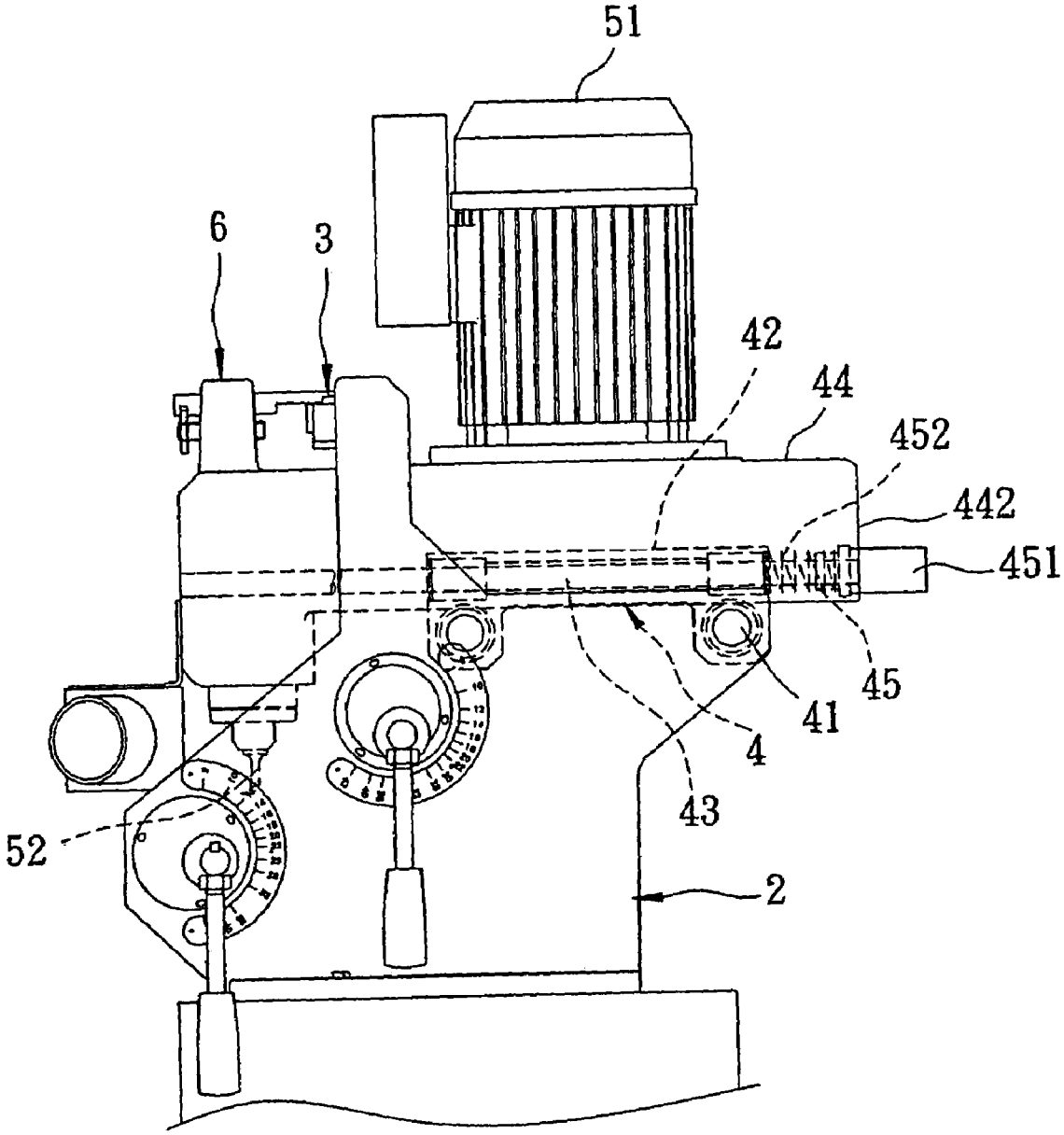
FIG. 6 is a partially cut-away side plan view of the semi-automatic mortising machine in accordance with another embodiment of the present invention.

Referring to FIG. 6, the elastic member 45 includes a bolt 451 screwed into and extended through a rear wall 442 of the slide box 44 along the Y-axis direction, and a compression spring 452 mounted on the bolt 451 and biased between the bolt 451 and the slide seat 42. Thus, the compression spring 452 pushes the slide box 44 backward toward the support bar 3 along the Y-axis direction, so that the slide box 44 is constantly moved toward the support bar 3.

Figure 7:
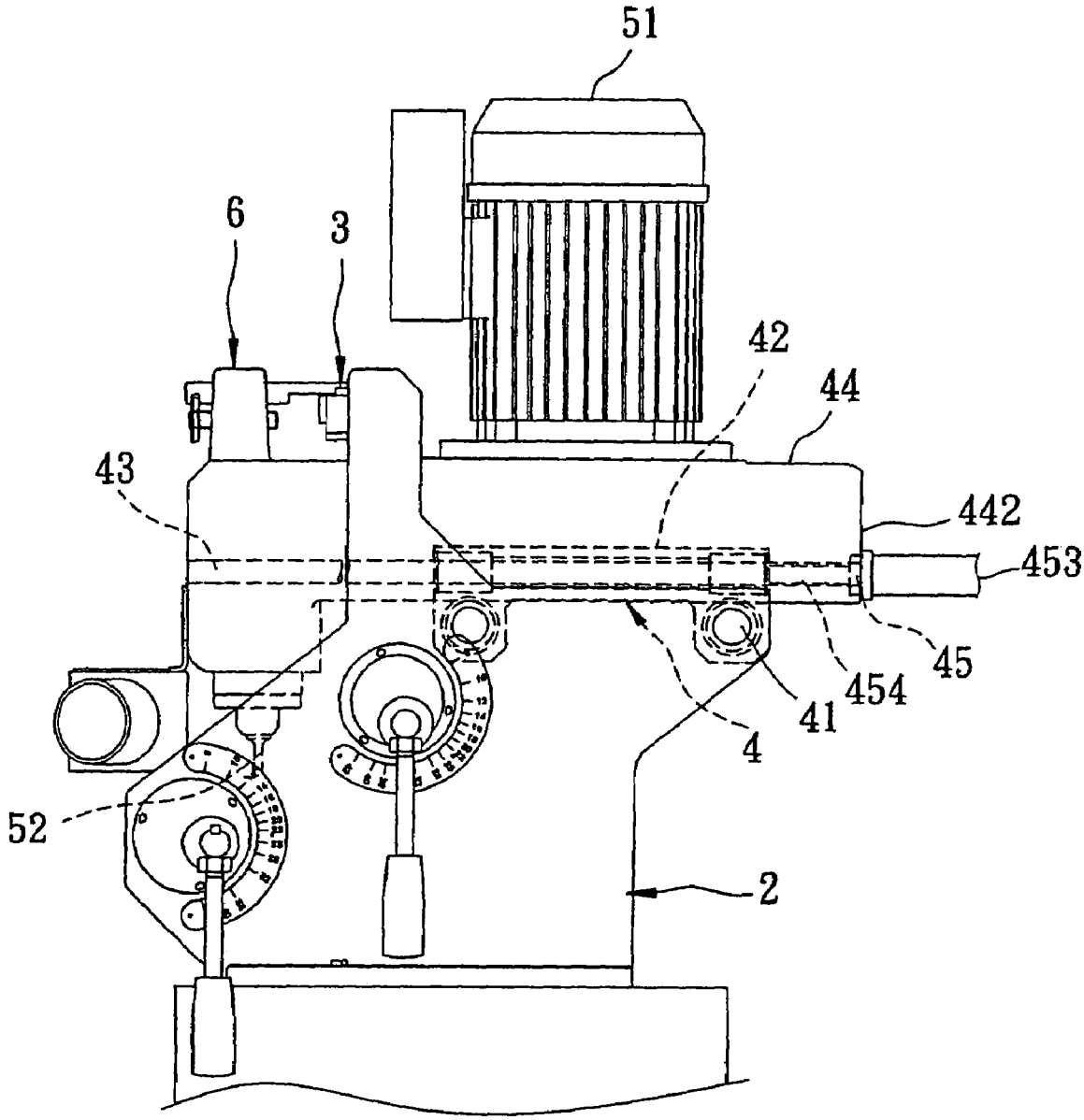
FIG. 7 is a partially cut-away side plan view of the semi-automatic mortising machine in accordance with another embodiment of the present invention.

Referring to FIG. 7, the elastic member 45 includes a press cylinder 453 extended through the rear wall 442 of the slide box 44 along the Y-axis direction, and a piston rod 454 secured on the slide seat 42 and retractably mounted on the press cylinder 453. Thus, the piston rod 454 is retracted to drive the slide box 44 to move backward toward the support bar 3 along the Y-axis direction, so that the slide box 44 is constantly moved toward the support bar 3.

Figure 8:
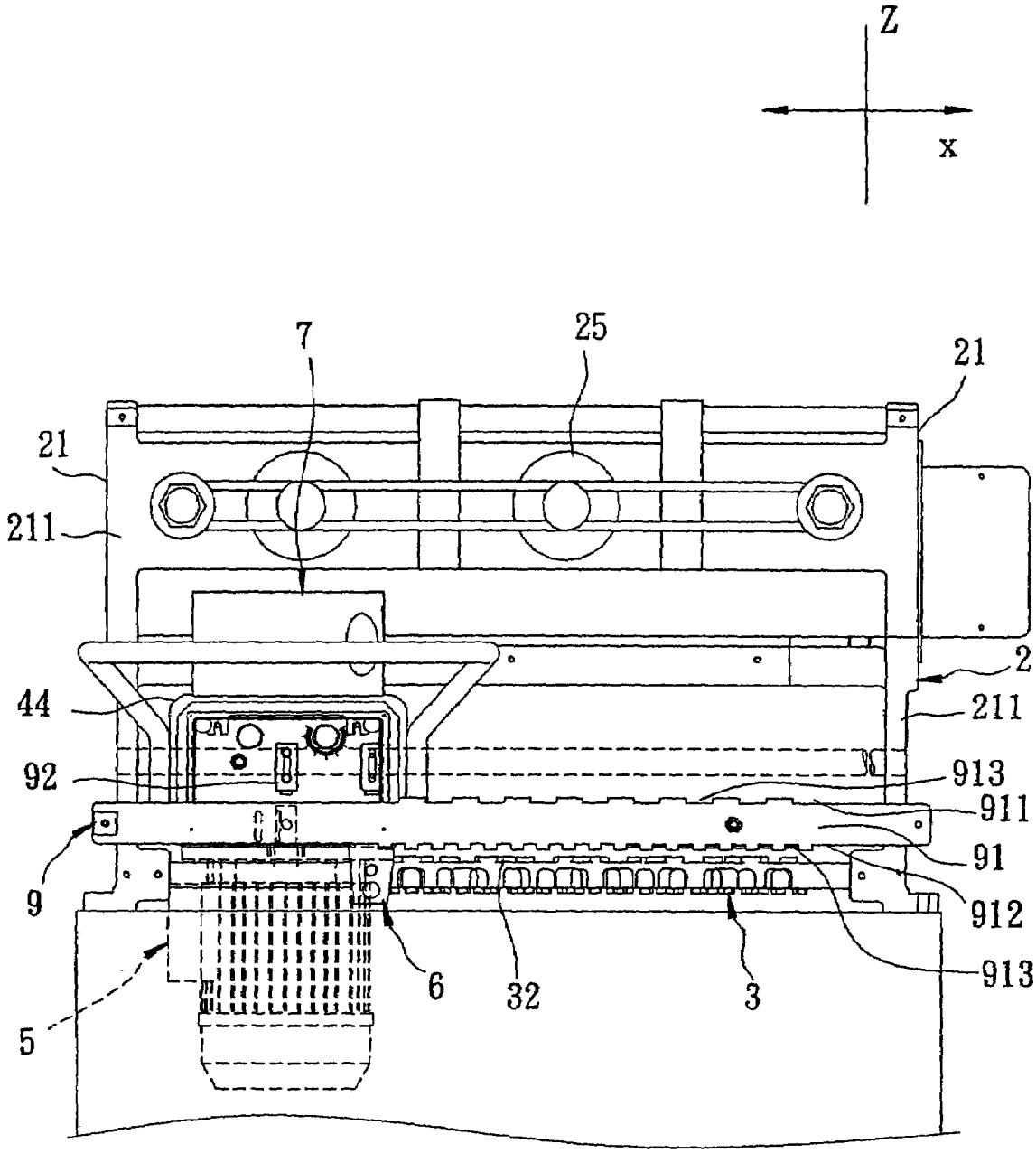
FIG. 8 is a partially cut-away front plan view of the semi-automatic mortising machine in accordance with another embodiment of the present invention.
Figure 9:
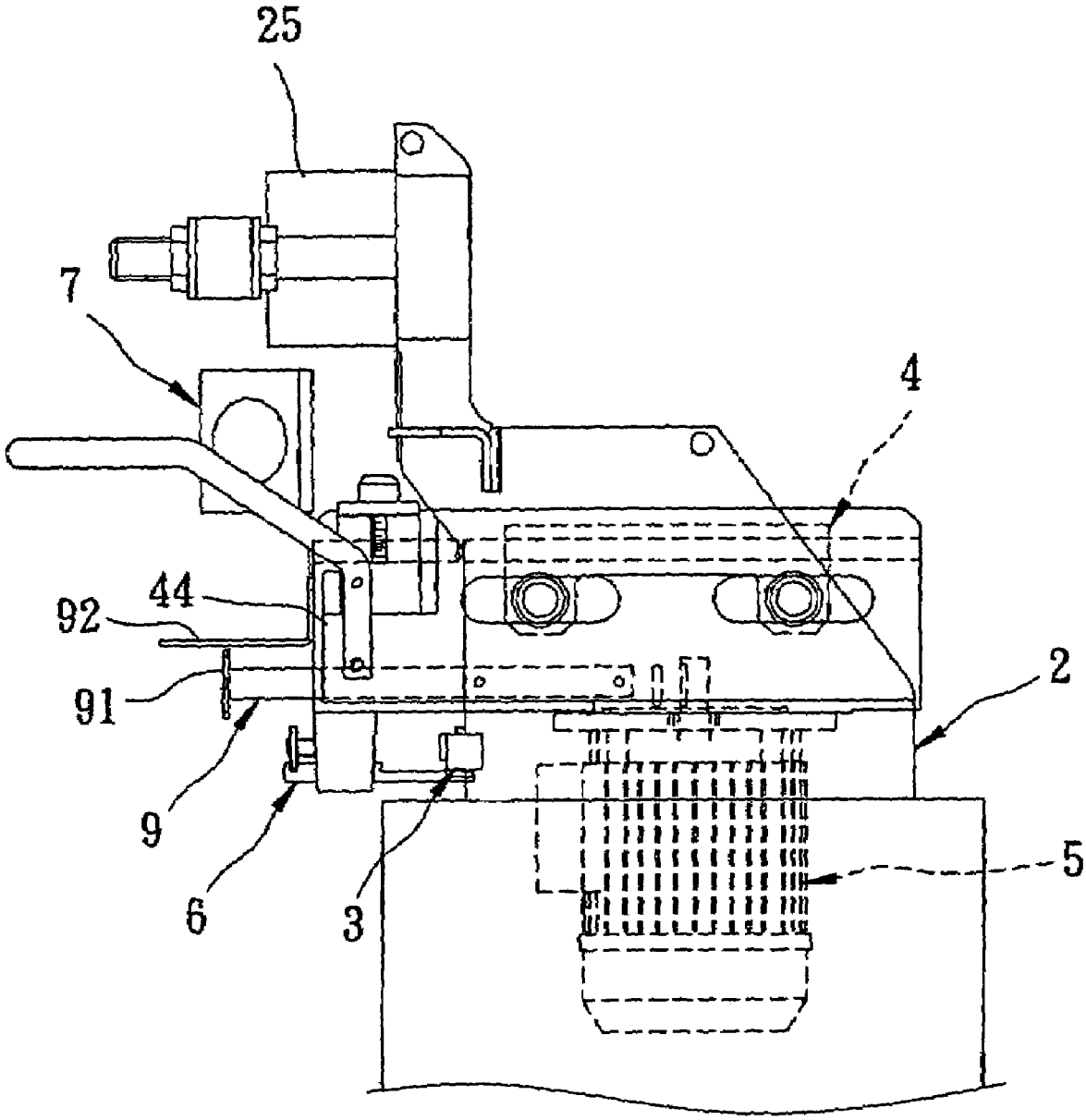
FIG. 9 is a side plan view of the semi-automatic mortising machine as shown in FIG. 8.

Referring to FIGS. 8 and 9, the support base 2 includes a plurality of press cylinders 25 for pressing the workpieces 8. The support bar 3 is located under the platforms 22 and 23. The distance adjusting device 6 is mounted on a bottom face of the slide box 44. Thus, the distance adjusting device 6 can drive the working device 5 to cut the mortises 81 and tenons 82 in the workpiece 8 according to the profile and distance of the tenons 32 of the support bar 3, so that the mortises 81 and tenons 82 of the workpiece 8 match the relative profile and distance of the respective tenons 32 of the support bar 3.

In addition, the semi-automatic mortising machine further comprises an indication device 9 including an indication bar 91 secured on a front end 211 of the respective side wall 21 of the support base 2, and a direction bar 92 secured on the slide box 44 and located above the indication bar 91. The indication bar 91 has a top face 911 and a bottom face 912 each formed with a plurality of recesses 913 wherein a distance between the recesses 913 is equal to that between the tenons 32 of the support bar 3. Thus, when the slide box 44 is moved along the moving track of the tenons 32 of the support bar 3, the direction bar 92 is moved with the slide box 44 in the X-axis direction, so that the direction bar 92 aligns the position of each of the mortises 81 and tenons 82 of the workpiece 8 with that of the respective recess 913 of the indication bar 91 so as to indicate the working condition of the workpiece 8 by the indication bar 91.

Accordingly, the displacement direction can be controlled in a manual manner during the working process, and the cutting operation is performed in an automatic manner so as to cut the mortises 81 and tenons 82 in the workpiece 8 so that the construction of the semi-automatic mortising machine is simplified. In addition, the semi-automatic mortising machine reduces possibility of malfunction. Further, the semi-automatic mortising machine facilitates the operator's maintenance. Further, the semi-automatic mortising machine maintains the quality of the products.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A semi-automatic mortising machine, comprising:

a support base including two side walls arranged in the X-axis direction, and at least one platform mounted between the two side walls for placing at least one workpiece;

a support bar mounted on the support base in parallel with the X-axis direction and having at least one side face formed with a plurality of tenons which are arranged in parallel with the X-axis direction;

a guide device mounted between the at least one platform of the support base and the support bar and operated in a manual manner to displace in parallel with the X-axis direction and in parallel with the Y-axis direction according to profiles of the tenons of the support bar; and a working device moved with the guide device and including a blade extended downward in the Z-axis direction to contact the at least one workpiece, so that the blade cuts mortises and tenons in the workpiece according to profiles of the tenons of the support bar; wherein the guide device includes two axial displacement rods each mounted between the two side walls of the support base, a slide seat slidably mounted on the two axial displacement rods to move in parallel with the X-axis direction, two radial displacement rods each extended through the slide seat to move in parallel with the Y-axis direction, and a slide box fixed on the two radial displacement rods to move therewith;

the guide device further includes an elastic member mounted between the slide seat and the slide box, so that the slide box is constantly moved toward the support bar.

2. The semi-automatic mortising machine in accordance with claim 1, wherein the elastic member includes a press cylinder extended through a rear wall of the slide box along the Y-axis direction, and a piston rod secured on the slide seat and retractably mounted on the press cylinder.

3. The semi-automatic mortising machine in accordance with claim 2, wherein the piston rod is retracted to drive the slide box to move toward the support bar along the Y-axis direction, so that the slide box is constantly moved toward the support bar.

* * * * *